US005305930A

United States Patent [19]

De Laforcade

[11] Patent Number: 5,305,930

[45] Date of Patent: Apr. 26, 1994

[54] ACTUATING DEVICE FOR DISPENSING A PRODUCT, ESPECIALLY A SELF-FOAMING PRODUCT

[75] Inventor: Vincent De Laforcade, Clamart, France

[73] Assignee: L'Oreal, Paris, France

[21] Appl. No.: 977,636

[22] Filed: Nov. 17, 1992

[30] Foreign Application Priority Data

Nov. 27, 1991 [FR] France ..... 91 14631

[51] Int. Cl.[5] ..... B65D 83/00

[52] U.S. Cl. ..... 222/402.13; 222/518; 239/116; 239/528

[58] Field of Search ..... 222/95, 105, 149, 150, 222/212, 402.12, 402.13, 402.21, 402.22, 402.23, 402.25, 404, 518; 239/114, 116, 120, 353, 354, 373, 528

[56] References Cited

U.S. PATENT DOCUMENTS

| | | | |
|---|---|---|---|
| 3,323,695 | 6/1967 | Monahon | 222/402.13 |
| 4,775,081 | 10/1988 | Morane | 222/402.13 |
| 4,860,933 | 8/1989 | Morane et al. | 222/518 |
| 4,901,891 | 2/1990 | Goncalves | 222/402.1 |
| 5,085,353 | 2/1992 | Inui et al. | 222/402.25 |
| 5,096,098 | 3/1992 | Garcia | 222/402.13 |
| 5,137,179 | 8/1992 | Stoffel | 222/105 |
| 5,205,443 | 4/1993 | Inui et al. | 222/402.13 |

FOREIGN PATENT DOCUMENTS

| | | |
|---|---|---|
| 0031123 | 7/1981 | European Pat. Off. . |
| 2338800 | 2/1975 | Fed. Rep. of Germany . |

*Primary Examiner*—Andres Kashnikow
*Assistant Examiner*—Philippe Derghshani
*Attorney, Agent, or Firm*—Cushman, Darby & Cushman

[57] ABSTRACT

The actuating device (1) is adapted to be incorporated into a dispenser provided with a valve (41) having a tubular end (43) which must be pressed in order to discharge the product. The device (1) includes a poppet valve (10), the movement of which is substantially transverse to the axis of the end (43). Action by the user on the push-button results, on the one hand, in opening of the poppet valve (10) and, on the other hand, in pressure being exerted on the tubular end (43) by the use of a film hinge (39). The vertical movement of the push-button is converted into a horizontal movement of the popper valve by means of an orthogonal joint. The product to be dispensed still pass into a chamber rendered airtight by the poppet valve (10) and a flexible collar (13), so that the product, especially a self-foaming product, remains hermetically sealed in the chamber during periods of non-use.

8 Claims, 3 Drawing Sheets

ACTUATING DEVICE FOR DISPENSING A PRODUCT, ESPECIALLY A SELF-FOAMING PRODUCT

This invention relates to an actuating device for dispensing a product, especially a self-foaming product, adapted to be incorporated into a dispenser provided with a valve having a vertical tubular outlet end.

BACKGROUND OF THE INVENTION

Aerosol cans are well known to the general public nowadays, and the commercial world has proposed a large variety of these which can contain liquid, gaseous, self-foaming or similar products. In the particular case of a self-foaming product, it is of course essential that the actuating device for dispensing the product is airtight, but also that the dispensing end does not contain a residual quantity of the product after use, which, exposed to the open air after use, would continue to foam even if the valve of the aerosol can were closed properly.

In order to obviate this disadvantage, EP Patent No. 0 031 123 proposes an actuating device provided with an obturating system complementary to that of the valve of the aerosol can, the said obturating system operating at the very end of the dispensing orifice so that any residual quantity of the product is no longer in contact with the air and so that, even if it continues to foam, it remains trapped by the airtightness of the actuating device. However, the arrangement of this known device is such that, on the one hand, the dispensing opening is always coaxial with the end of the valve of the aerosol can and, on the other hand, the tightness of the closure of the outlet orifice can be reduced in the course of time as a result of the fact that opening/closure is ensured by the deformation of a plastic component which thus becomes fragile.

SUMMARY OF THE INVENTION

The aim of this invention is to obviate these disadvantages by proposing a device, the airtightness of which is reliable and in which the direction of dispensing can be perpendicular to the axis of the tubular end of the valve of the dispenser.

The term dispenser refers to a device forming part of the assembly formed by any conventional aerosol, any aerosol in which the product to be-dispensed is physically separated from the propellant means container in the same container, an aerosol of this kind including either a flexible or semi-flexible pouch or a piston in the container, or any aerosol in which the propellant means consists of an elastically retractable pouch.

According to this invention, an actuating device for dispensing a product, especially a self-foaming product, including a baseplate provided with fixing means to be fixed to a container containing the said product and provided with a valve having a vertical tubular outlet end which is pressed downwards to discharge the product from the container, and including a hollow body generally in the form of a cylindrical chamber provided with an inlet to be connected to the said tubular end and an outlet orifice in the form of a poppet valve seat which is arranged on one of the two bases of the cylindrical chamber and can be closed by a poppet valve coaxial with the cylinder, is characterised in that the axis of the cylindrical chamber is substantially transverse to the axis of the tubular end, the inlet provided in the cylindrical chamber is an inlet directed substantially transversely with respect to the axis of the chamber, and in that the said poppet valve is movable towards the interior of the chamber, disposed in the interior of the chamber and extended by a control rod which horizontally traverses the other base of the cylindrical chamber in order to open or not to open the outlet orifice of the chamber.

Some product will therefore still remain in the cylindrical chamber after use, but, on the one hand, it will of course not be in contact with the ambient air and, on the other hand, it will kept hermetically sealed in the chamber all the better as the poppet valve head will be pressed even harder against the poppet valve seat if any excess pressure is produced in the interior of the chamber.

According to a preferred embodiment, the said baseplate and the said cylindrical chamber are connected by means of a hinge having a horizontal axis allowing for substantially vertical movement of the chamber in order to depress or not to depress the end of the valve, and the said control rod is connected to a push-button by an orthogonal joint so that, on the one hand, when downward vertical pressure is exerted on the push-button, firstly, the control rod is driven horizontally and opens the poppet valve and, secondly, the chamber pivots about the hinge in order to depress the end of the valve, resulting in the product being dispensed through the chamber and its outlet orifice and, on the other hand, when the vertical pressure on the push-button ceases, the end of the valve and the poppet valve return to the closed position, thereby stopping dispensing of the product and confining a certain quantity thereof in the chamber in a sealed manner.

Therefore, as a result of the presence of the orthogonal joint, a vertical movement for opening the valve of the aerosol bottle also allows for horizontal opening of the chamber.

The part of the body of the chamber situated opposite the outlet orifice is advantageously provided with an annular flange to which the push-button is clipped, said push-button being in the form of a flexible dish provided axially towards the bottom with an intermediate control shaft extending as far as the said orthogonal joint, the said flexible dish being adapted so that the intermediate control shaft is guided vertically and that the-flexible dish serves as a return spring when vertical pressure on the push-button ceases. In this manner, the guiding function of the control push-button and the return spring function of the actuating means are effected in a particularly economical manner.

In a preferred embodiment, the said orthogonal joint consists, on the one hand, in the body of the chamber, of a convex surface substantially in the shape of a quadrant, the upper part of which is tangential to the said control rod where it emerges from the base of the cylindrical and, on the other hand, of the said control rod which consists of a flexible material, so that when it is urged downwards, it assumes the shape of the said convex surface. Although various more or less complicated mechanical device can be proposed in order to produce the said orthogonal joint, the function of which is to convert the vertical movement of the push-button into a horizontal movement of the poppet valve stem, the solution adopted is clearly more economical. It advantageously allows the poppet valve, the poppet valve stem, the control rod, the intermediate control shaft and the flexible dish to be formed in one single piece of moulded plastic, the flexible parts of which, i.e. the dish and the control rod, serve as a return spring. The moderate nature of the means used is remarkable.

As the passage of the control rod through the base of the cylindrical chamber is not necessarily hermetic, it is advantageous for the said single moulded component to moreover include at the connection between the poppet valve stem and the control rod a sealing collar in the form of a flexible lip to bear permanently against the inner face of the chamber and thus to ensure the tightness of the passage of the control rod irrespective of the open or closed position of the poppet valve. The quantity of product present in the chamber therefore cannot emerge at the poppet valve or at the control rod.

In a preferred embodiment, the chamber body consists of two half shells abutting along a substantially horizontal assembly plane defining the said passage of the control rod, the upper half shell consisting in particular of the annular flange adapted for the clipping of the push-button, a passage for the said intersemiate control shaft, a half chamber and the poppet valve seat, the lower half shell consisting-in particular of a second half chamber complementary to the previous one, the said convex surface and the said inlet to be connected to the tubular end of the valve, and the two half shells are assembled together in a sealed manner along their assembly plane once the said single component formed by the poppet valve and the push-button has been disposed therein. There once again, the solution adopted is particularly economical as each half shell is a component that can be moulded in a simple manner.

The lower half shell is advantageously hinged on to the said baseplate by means of a flexible film hinge, so that the said lower half shell and the said baseplate form one single component of moulded plastic. This hinge is the most economical method of producing the hinge having a pivoting axis provided in the actuating device for depressing or not depressing the end of the valve.

In order to fix the entire actuating device formed in this manner to the container, it can be provided that the means for fixing the said baseplate to the valve consists of an inner annular clipping flange-formed in the bottom of the baseplate in order to be clipped on to the crimp of the valve. This arrangement is such that the same moulded component forms the lower half shell, the flexible hinge, the baseplate and the means for fixing it to the container.

The object of this invention will be more readily understood from the following description of one embodiment given purely by way of a non-limiting example and illustrated in the accompanying drawings, in which:

DETAILED DESCRIPTION OF THE INVENTION

Figure 1:
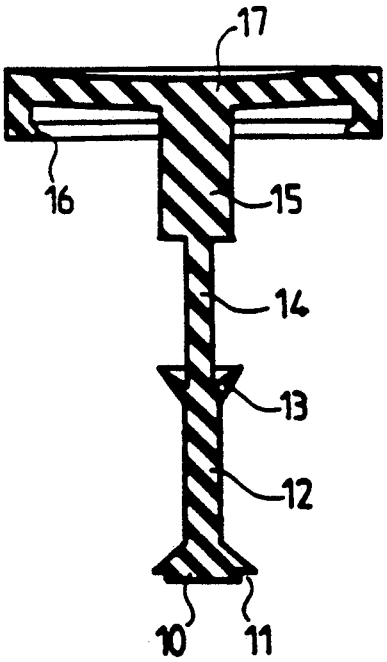
FIG. 1 and FIG. 1*a* are sections of very similar variants of a single component serving as the poppet valve and the push-button.
Figure 1A:
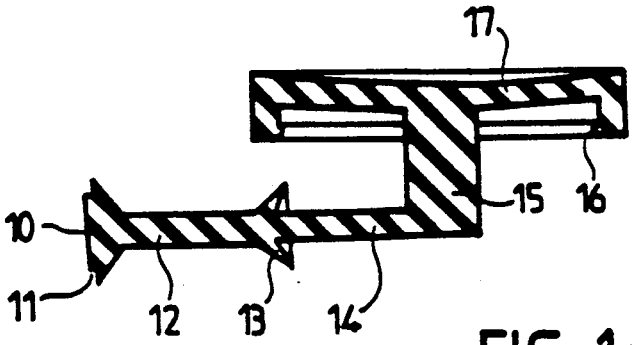
Figure 2:
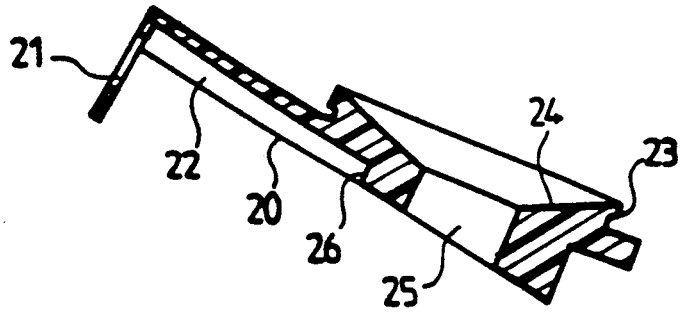
FIG. 2 is a section of an upper half shell.
Figure 3:
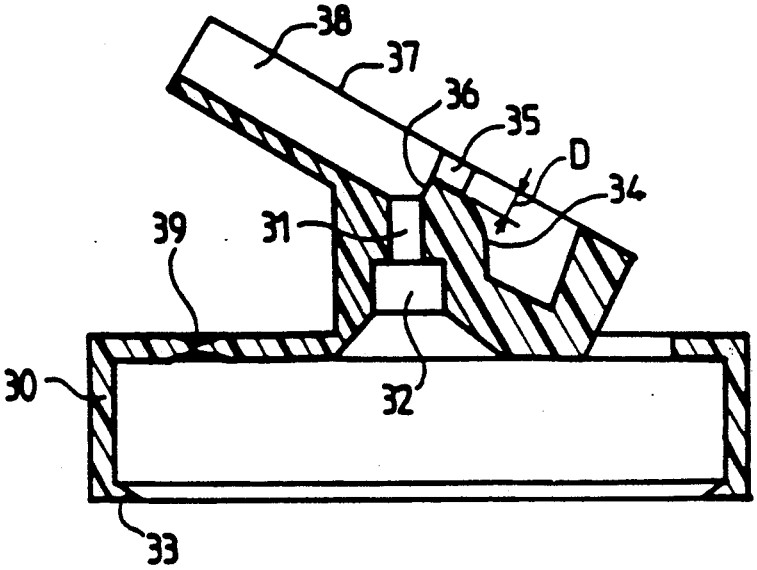
FIG. 3 is a section of a lower half shell.
Figure 4:
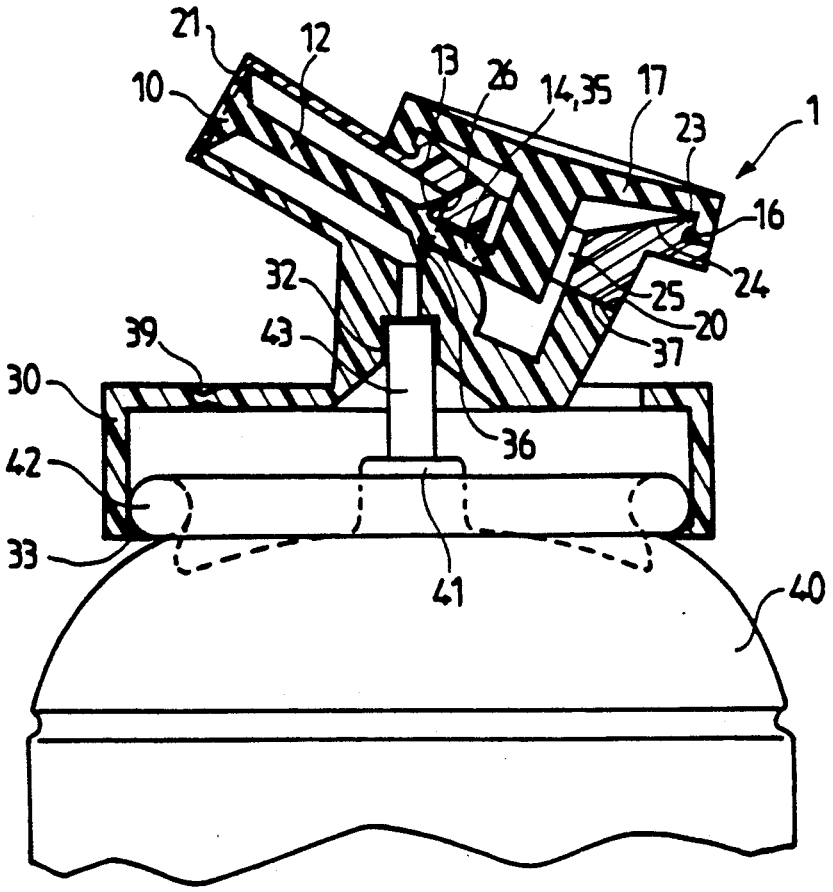
FIG. 4 is a section of the device according to the invention in the closed position.

FIGS. 1*a*, 2 and 3 show the elements forming a device according to the invention, FIG. 4 showing these elements once assembled. Each element will first be described separately.

As can be seen, FIG. 1 is a very similar variant of the preferred embodiment of FIG. 1*a*. As a result of this great similarity, the same reference numerals and the same description will be used for the two figures. This component is the single component forming the poppet valve and the push-button. The poppet valve head 10 having a bearing surf ace 11 in the form of an annular shoulder is shown at one end. This is followed by the poppet valve stem 12 and a little further on by a sealing collar 13. All of these first elements preferably have a circular section. The poppet valve stem 12 is rigid, as are the poppet valve head 10 and its bearing surface 11, while the sealing collar 13 has a certain flexibility as a result of the f act that its thickness decreases towards its maximum diameter, allowing it to act as a sucker when it bears against a planar surface. This is then followed by the control rod 14, the section of which is, e.g. rectangular, the thickness of the rectangle being sufficiently small for the control rod 14 to display a certain degree of flexibility. This is then followed by the intermediate control shaft 15, preferably of cylindrical shape and attached to the centre of a flexible cup 17, the rigid periphery of which includes an annular clipping flange 16. As a result of the flexibility of the control rod 14, it will be clear that the variants of FIG. 1 and FIG. 1*a* are simply two methods of moulding one single component, all the functions of which are retained, and the control rod 14 of FIG. 1 simply has to be folded to give the same arrangement as that of FIG. 1*a*.

FIG. 2 shows a half shell including a half chamber 22 defined by an assembly plane 20. A poppet valve seat 21 is shown at one end of the half chamber, situated on the inner face of the half chamber 22, the poppet valve seat 21 being an orifice of revolution. A half sealing bearing surface 26 is situated at the other end of the half chamber. A passage 25 of preferably cylindrical section, the axis of which is substantially perpendicular to the assembly plane 20, is situated beyond this same end of the half chamber. This cylindrical passage opens on to a dish 24 which widens towards an annular clipping ring 23.

FIG. 3 shows the other half shell with its baseplate. The baseplate 30 is in the general shape of a cylinder open towards the bottom, its lower end being provided with an annular clipping flange 33. The upper base of the cylinder is not closed and it includes a flexible film hinge 39 disposed perpendicularly to the axis of the cylinder and spaced relatively far from the latter. This film hinge 39 connects the baseplate 30 to the half shell which includes a half chamber 38 defined by an assembly plane 37 and one end of which is provided with a half sealing bearing surface 36. A passage 35 is formed perpendicularly to this sealing bearing surface 36, the thickness D of said passage being substantially equal to the thickness of the control rod 14 mentioned hereinabove. The half chamber 38 moreover includes an inlet conduit 31 which communicates with a cylindrical housing 32 coaxial with the baseplate 30. In the drawing, the assembly plane 37 is shown to be relatively inclined with respect to the common axis of the baseplate 30 and the housing 32, but this is not essential and the assembly plane 37 could just as easily be substantially perpendicular to this axis. Consequently, the axis of the inlet conduit 31 can be considered to be substantially transverse with respect to the half chamber 38. A convex surface in the form of the arc of a circle 34 can be seen beyond the passage 35, the upper end of said surf ace being tangential to the lower edge of the passage 35.

FIG. 4 shows the actuating device 1 for dispensing a product according to the invention in the closed position, mounted on a container of the aerosol can -type 40. The aerosol can 40 is provided with a valve 41 generally fixed to the aerosol can 40 by means of a crimp 42. The valve 41 includes a tubular end 43 disposed vertically which it is known to be advantageous to depress in order to discharge the product contained in the aerosol can.

The actuating device 1 for dispensing a product is mounted as follows. The annular flange 16 is clipped on to the annular ring 23 after the introduction of the poppet valve head 10 through the passage 25 of the upper half shell, then the control rod 14 is inserted into the passage 35 of the lower half shell, thereby allowing the assembly plane 20 to be located opposite the assembly plane 37, taking care to dispose the poppet valve head 10 opposite the poppet valve seat 21 and not to damage the sealing collar 13 bearing, on the one hand, against the half sealing plane 36 and, on the other hand, against the half sealing plane 26. Assembly means, e.g. welding means, are provided for assembling the two half shells in a sealed manner along their assembly planes.

The device 1 according to this invention designed in this manner is not difficult to mount on the aerosol can 40. The annular clipping flange 33 of the baseplate 30 is snapped on to the crimp 42 of the valve 41, after checking that the tubular end 43 of the valve 41 is correctly housed in the housing 32 of the lower half shell. This checking can be effected, e.g. visually, as normally the flexible film hinge 39 must not be folded in either direction. The aerosol can 40 provided with the device 1 according to the invention is then ready for use, as shown in FIG. 4 in the ready position, i.e. a closed, sealed position.

Figure 5:
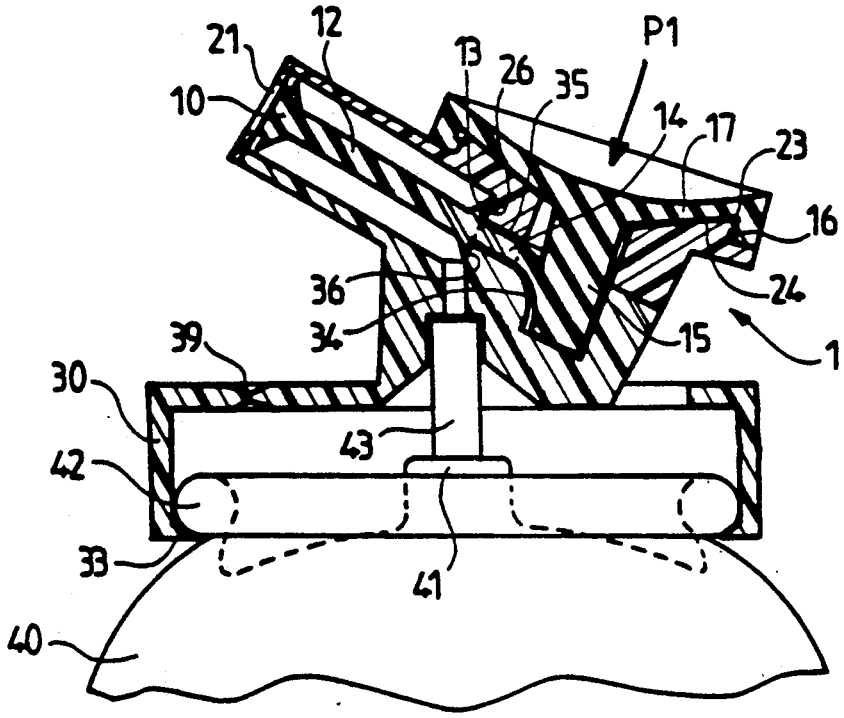
FIG. 5 shows the device of FIG. 4, with the poppet valve in the open position.
Figure 6:
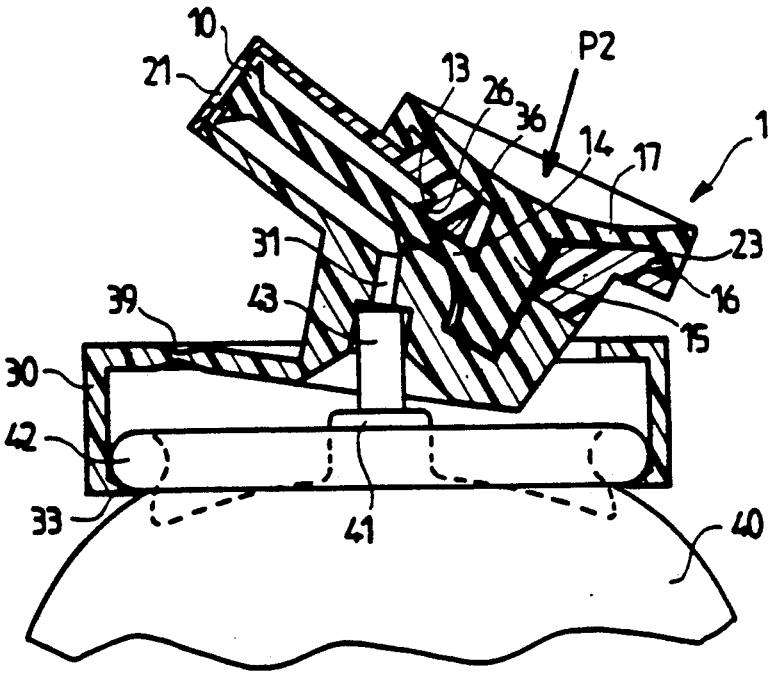
FIG. 6 shows the device of FIGS. 4 and 5, with the poppet valve in the open position and the end depressed in order to dispense the product.

The device 1 is operated in two stages controlled by one single movement, these two stages being shown in FIGS. 5 and 6 respectively.

FIG. 5 shows what happens when a first pressure Pl is exerted on the flexible cup 17 serving as a push-button. As a result of the fact that the annular flange 16 is clipped on to the annular ring 23, pressure P1 on the flexible cup 17 forces the intermediate control shaft 15 to be displaced downwards in a direction perpendicular to the clipping plane. This movement drives the control rod 14 which, bearing flexibly against the convex arc of a circle 34, is drawn towards the outside of the chamber through the passage 35, taking with it the poppet valve stem 12 and the poppet valve head 10, thereby opening the outlet orifice of the chamber.

During this movement, the sealing collar 13 continues to bear against the two half sealing planes 26, 36 of the chamber, the lips of the collar being slightly widened to maintain the tightness of the arrangement. When the flexible cup 17 copies to a stop against the dish 24, the chamber is opened and the first stage of the operation of the device according to the invention is completed.

FIG. 6 shows what happens when the pressure P1 is followed by a pressure P2 exerted in the same direction. At this moment, the pressure P2 acts on the integral assembly formed by the two half shells and causes the film hinge 39 to be folded downwards, thereby depressing the tubular end 43 of the valve 41, which is thus opened to allow the product contained in the aerosol can 40 to be discharged. During this second stage, which is now complete, it is clear that the-outlet orifice of the chamber remains open and thus the product contained in the aerosol can 40 follows the path formed by the tubular end 43, the inlet 31 into the chamber and the outlet of the chamber, the product then being available to the user as long as the pressure P2 is maintained.

After use, the user of course ceases to exert pressure on the flexible cup 17 and the device 1 returns by itself to the position of FIG. 4, as, on the one hand, the spring of the valve 41 pushes back the tubular end 43, thereby closing the valve and returning the film hinge 39 to its horizontal position and, on the other hand, the flexible cup 17 serves as a return spring to draw the intermediate control shaft 15 upwards, thereby bringing the poppet valve head 10 to bear in a sealed manner against the poppet valve seat 21, while the sealing collar 13 continues to bear in a sealed manner against the surface 26, 36 as a result of the fact that its flexible lips are slightly contracted. At this moment, a certain quantity of the product is trapped in a sealed manner in the chamber from which it cannot emerge, even if it is a self-foaming gel, such as solution of isobutane, which, at atmospheric pressure, boils at 28° C., producing foam. The actuating device 1 for dispensing a product, especially a self-foaming product, therefore always remains clean as a result of the airtightness of the chamber.

It may be noted that if firm, rapid pressure is exerted on the flexible cup 17, it is possible for the two stages of FIGS. 5 and 6 to be effected almost simultaneously, or even in reverse. It is clear that this does not prevent the correct operation of the device according to the invention, the chamber of which will remain sealed when it returns to the rest position shown in FIG. 4.

Figure 7:
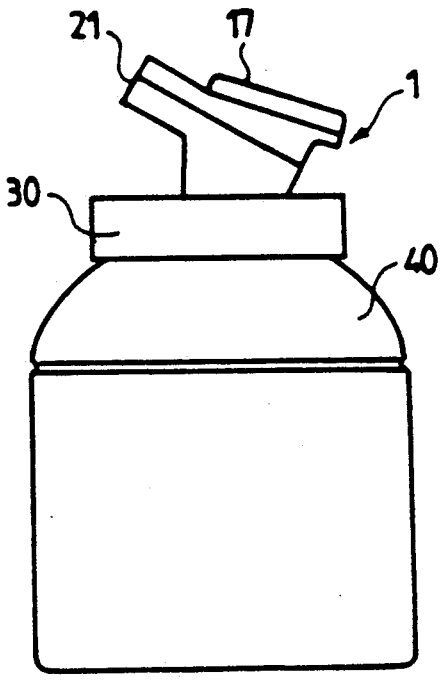
FIGS. 7 and 8 are general front and side views of an aerosol can provided with the device according to the invention.
Figure 8:
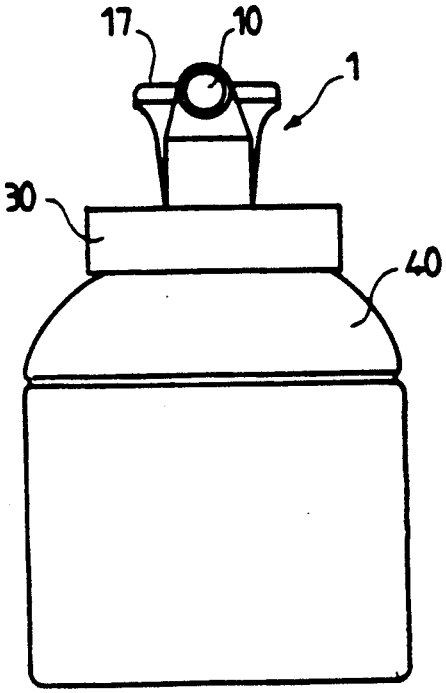

FIGS. 7 and 8 are front and side views given purely by way of example of an aerosol can ready for use, equipped according to this invention. They show the aerosol can 40 provided with the dispenser 1 with its baseplate 30, the poppet valve head 10 and the periphery of the flexible dish 17 serving as a push-button.

I claim:

1. An actuating device for dispensing a product of the self foaming type and stored in a container of the type having a rim surrounding a tubular valve outlet that is pressed inwardly to effect dispensing, said actuating device comprising a base having means for fixing said base on the rim of the container, a hollow body having a cylindrical chamber including one end having an inlet located adjacent the tubular valve outlet when said device is mounted on the rim of the container and an opposite end including an outlet orifice in the form of a poppet valve seat, a poppet valve member disposed coaxially in said cylindrical chamber and movable along said chamber from a first position closing said outlet orifice by engaging said seat to a second position opening said outlet orifice, said cylindrical chamber having a longitudinal axis which extends generally transverse to the axis of the tubular valve outlet, said inlet of said hollow body including an axis extending transverse to said axis of said cylindrical chamber, said poppet valve member including an extension control rod extending beyond said inlet of said hollow body and out of said cylindrical chamber, said extension control rod controlling movement of said poppet valve member, said base and said cylindrical chamber being connected by a hinge allowing movement of said cylindrical chamber whereby the tubular valve outlet may be moved upon pivotal movement of said cylindrical chamber about said hinge, said control rod being connected to a push member, said push member being located on a base member connected to said base, said base member having an axial opening receiving a portion of said push member and a recess provided at one end of said axial opening allowing movement of said push member into said recess, said push member having another portion extending into said axial opening and being connected through an orthogonal joint to said control rod so that, upon movement of said push member into said recess, said control rod will be withdrawn from said cylindrical chamber to thereby move said poppet valve member from said first position toward said second position and causing said chamber to move about said hinge to actuate said tubular valve outlet to cause the product to be dispensed through said cylindrical chamber and said outlet orifice and movement of said push member away from said recess will cause said control rod to allow said poppet valve to move to said first position and said tubular valve outlet to cease dispensing of the product while confining a quantity of the product in said cylindrical chamber.

2. The invention as claimed in claim 1 wherein said base member has an exterior wall surrounding said recess, said exterior wall having an annular flange formed with a groove and said push member having a substantially annular lip portion received in said groove of said annular flange to retain said push member in position, said push member comprising a resiliently flexible, dish-shaped body and said another portion thereof comprising an intermediate control shaft so that said dish-shaped body will move said shaft axially of said axial opening when pressure on said body is released.

3. The invention as claimed in claim 2 wherein said axial opening has an interior wall and a bottom, a portion of said interior wall curving away from said bottom to define a convex surface having an upper part extending tangentially to a portion of said control rod where said control rod enters said cylindrical chamber, said control rod being made of a resiliently flexible material to allow a portion of said control rod to conform to said convex surface when said push member is moved into said recess.

4. The invention as claimed in claim 3 wherein said poppet valve member, said control rod, said control shaft and said push member being molded integrally as a single component of a plastic material that is resilient so that said push member and said control rod, when flexed, will return to a rest position.

5. The invention as claimed in claim 4 wherein said single component includes a stem having one end adjacent said inlet to said cylindrical chamber, a sealing face surrounding said inlet and a peripheral sealing collar at said one end of said stem including a flexible lip in sealing engagement with said sealing face for each position of said control rod and poppet valve.

6. The invention as claimed in claim 5 wherein said hollow body of said device includes upper and lower complementary bodies which are attached to define said cylindrical chamber and a passage for said control rod, said upper body including said annular flange and said opening for receiving said control shaft, a wall portion providing the upper wall of said cylindrical chamber and a poppet valve seat, said lower body including said convex surface and said inlet for the tubular valve outlet.

7. The invention as claimed in claim 6 wherein said lower body is hinged to said base by a flexible film strip and said base and said lower body are formed as a single molded component.

8. The invention as claimed in claim 1 wherein said means for fixing said base on the rim of a container comprises an annular clipping flange depending from said base.

* * * * *